US012566021B2

(12) United States Patent
Schroeder et al.

(10) Patent No.: US 12,566,021 B2
(45) Date of Patent: Mar. 3, 2026

(54) SELF-METERING FLUID DISPENSING DEVICE

(71) Applicant: Haier US Appliance Solutions, Inc., Wilmington, DE (US)

(72) Inventors: Michael Goodman Schroeder, Crestwood, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 149 days.

(21) Appl. No.: 18/503,434

(22) Filed: Nov. 7, 2023

(65) Prior Publication Data

US 2025/0146727 A1 May 8, 2025

(51) Int. Cl.
*F25C 1/25* (2018.01)

(52) U.S. Cl.
CPC ..... *F25C 1/25* (2018.01); *F25C 2400/14* (2013.01); *F25C 2600/04* (2013.01); *F25C 2700/04* (2013.01)

(58) Field of Classification Search
CPC .... F25C 1/25; F25C 2400/14; F25C 2600/04; F25C 2700/04
See application file for complete search history.

(56) References Cited

U.S. PATENT DOCUMENTS 2,691,275 A * 10/1954 Andrews ..... F25C 1/12 62/320
3,921,414 A * 11/1975 Bright ..... F25C 1/04 62/353
5,056,325 A * 10/1991 Josten ..... F25C 1/12 62/126
5,477,694 A * 12/1995 Black ..... F25D 17/065 62/73
5,555,743 A * 9/1996 Hatanaka ..... F25C 1/25 62/347
5,904,054 A * 5/1999 Lee ..... F25C 1/25 62/347
7,201,014 B2 * 4/2007 Hornung ..... F25C 1/08 62/347
8,651,330 B2 * 2/2014 Krause ..... F24H 15/248 222/129
9,976,786 B2 * 5/2018 Beuligman ..... F25C 1/25
10,480,844 B2 * 11/2019 Broadbent ..... F25C 1/25
10,889,480 B2 * 1/2021 Mitchell ..... G01F 15/005
2013/0327074 A1 * 12/2013 Lee ..... F25C 1/04 62/177

FOREIGN PATENT DOCUMENTS

EP 4155632 A1 3/2023
JP 2000039242 A 2/2000
WO WO2021141070 A1 7/2021

* cited by examiner

*Primary Examiner* — Nicolas A Arnett
(74) *Attorney, Agent, or Firm* — Dority & Manning, P.A.

(57) ABSTRACT

A fluid metering system includes an upper chamber and a lower chamber, with a supply conduit providing a flow of fluid into the lower chamber. The flow of fluid lifts the float to a predetermined fluid volume and the float seals the lower chamber. A delivery conduit is coupled to the lower chamber and a dispensing valve. The dispensing valve is operated to dispense the predetermined fluid volume to a downstream assembly.

20 Claims, 5 Drawing Sheets

SELF-METERING FLUID DISPENSING DEVICE

FIELD OF THE INVENTION

The present disclosure relates generally to a device for metering an amount of dispensed fluid, in particular a self-metering valve for supplying water to an icemaker.

BACKGROUND OF THE INVENTION

Known ice makers typically rely on a timed dispense of water to fill an ice cube mold with the proper volume of water. The consistency of the fill often depends on the pressure of the water supply, which may vary depending on the water source, the water provider, or the plumbing at the installation site of the ice maker. Although water pressure design standards exist, the water pressure in many domestic settings falls above or below the design range. The result is either overfilling or underfilling the ice cube mold.

Improper ice cube mold fills, either over or under the anticipated volume, can cause poor quality ice production or inefficient ice production, leading to consumer dissatisfaction. Accordingly, improvements to metering of water volume for ice makers may be desirable. In particular, water metering devices for ice makers that supply a volume of water independent of the supply water pressure may be particularly useful.

BRIEF DESCRIPTION OF THE INVENTION

Aspects and advantages of the invention will be set forth in part in the following description, may be apparent from the description, or may be learned through practice of the invention.

In one exemplary aspect, a fluid metering system for an ice making assembly defining an axial direction, a radial direction, and a circumferential direction is presented. The fluid metering system comprises a housing comprising a perimetral wall defining a chamber and a flange dividing the chamber into an upper chamber and a lower chamber, the flange defining a vent hole. A float is constrained for axial displacement within the lower chamber between a lowered position in which the float is spaced apart from the flange and a raised position in which the float engages the flange. A supply conduit provides fluid communication between the lower chamber and a water supply, and a delivery conduit provides fluid communication between the lower chamber and an ice mold, with a supply valve fluidly coupled to the supply conduit between the lower chamber and the water supply and a delivery valve fluidly coupled to the delivery conduit between the lower chamber and the ice mold. A controller is in operative communication with the supply valve and the delivery valve, the controller configured to operate the delivery valve to a closed position and operate the supply valve to an open position to allow a fluid volume to flow from the water supply to the lower chamber, wherein the fluid volume moves the float to the raised position and the fluid volume is defined within the lower chamber by the housing, the float, and the flange. The controller is further configured to operate the supply valve to a closed position and operate the delivery valve to an open position to allow the fluid volume to flow from the lower chamber to the ice mold.

In another exemplary aspect, a refrigerator appliance is presented, the refrigerator comprising a fluid metering system for dispensing fluid to an ice making assembly. The fluid metering system comprises a housing comprising a perimetral wall defining a chamber, and a flange dividing the chamber into an upper chamber and a lower chamber, the flange defining a vent hole. A float is constrained for axial displacement within the lower chamber between a lowered position in which the float is spaced apart from the flange and a raised position in which the float engages the flange. a supply conduit provides fluid communication between the lower chamber and a water supply and a delivery conduit provides fluid communication between the lower chamber and an ice mold. The fluid metering system further comprises a supply valve fluidly coupled to the supply conduit between the lower chamber and the water supply, a delivery valve fluidly coupled to the delivery conduit between the lower chamber and the ice mold, and a controller in operative communication with the supply valve and the delivery valve. The controller is configured to operate the delivery valve to a closed position and operate the supply valve to an open position to allow a fluid volume to flow from the water supply to the lower chamber. The controller is further configured to operate the supply valve to a closed position and operate the delivery valve to an open position to allow the fluid volume to flow from the lower chamber to the ice mold, wherein the lower chamber, the float in the raised position, and the flange define the fluid volume.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
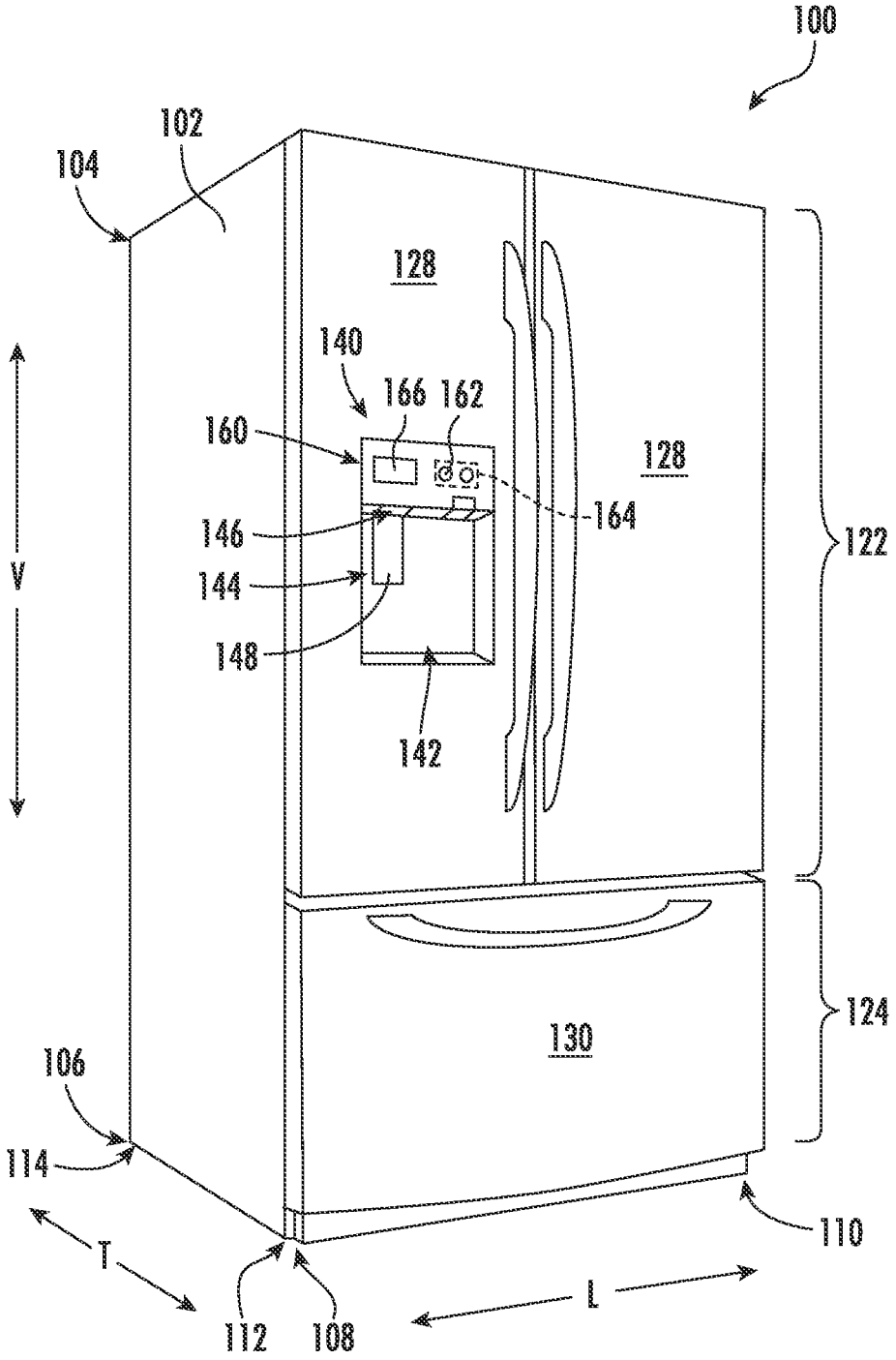
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

Cabinet 102 defines chilled chambers for receipt of food items for storage. In particular, cabinet 102 defines fresh food chamber 122 positioned at or adjacent top 104 of cabinet 102 and a freezer chamber 124 arranged at or adjacent bottom 106 of cabinet 102. As such, refrigerator appliance 100 is generally referred to as a bottom mount refrigerator. However, the inventive aspects of the present disclosure apply to other types and styles of refrigerator appliances, such as e.g., a top mount refrigerator appliance, a side-by-side style refrigerator appliance, a single door refrigerator appliance, etc. Consequently, the description set forth herein is for illustrative purposes only and is not intended to be limiting in any aspect to any particular configuration.

Refrigerator doors 128 are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
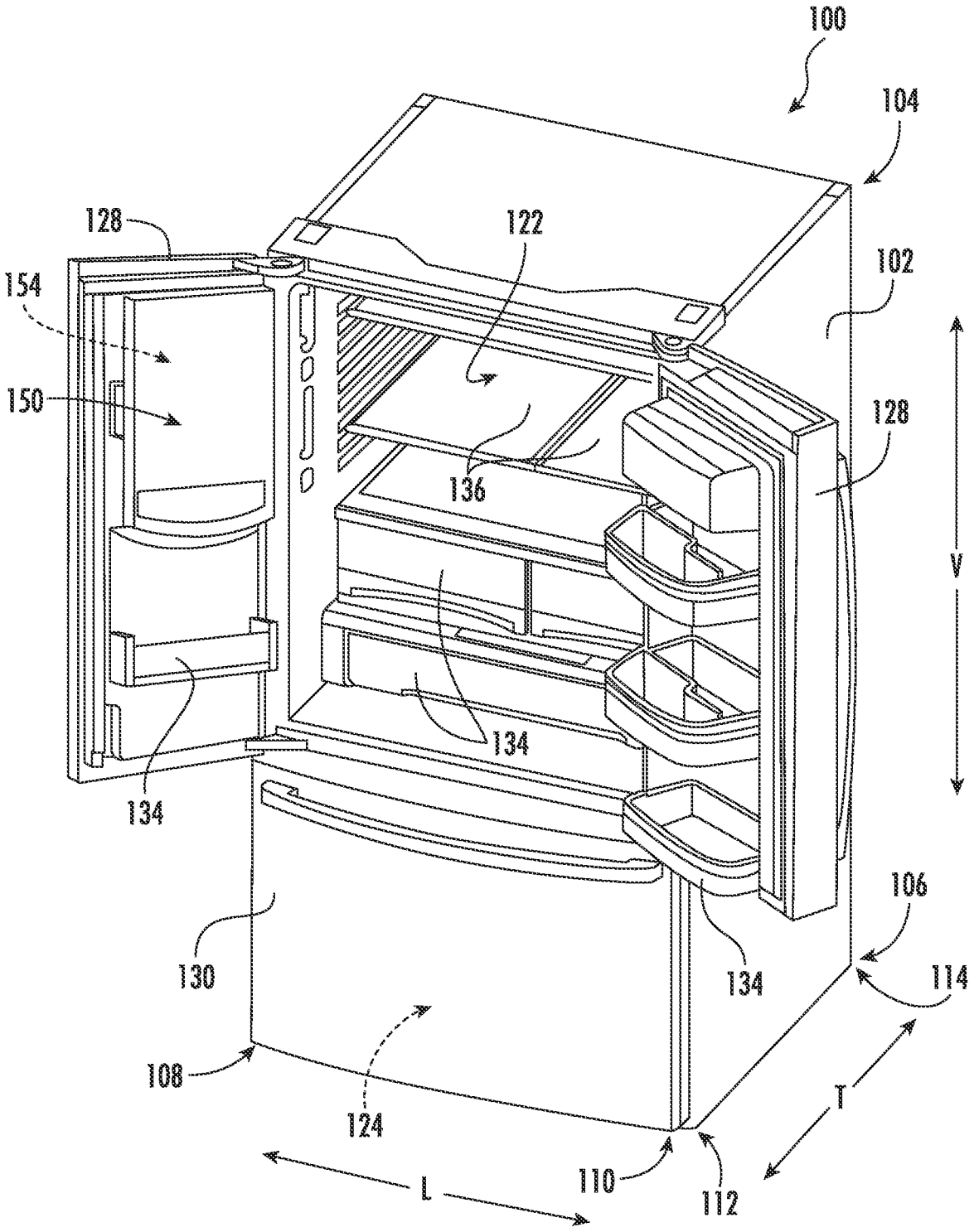
FIG. 2 provides a perspective view of the refrigerator appliance of FIG. 1 and depicts the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, as shown, refrigerator appliance 100 includes a dispensing assembly 140. Dispensing assembly 140 is generally configured for dispensing liquid water and/or ice. Dispensing assembly 140 and its various components may be positioned at least in part within a dispenser recess 142 defined on one of refrigerator doors 128. In this regard, dispenser recess 142 is defined at front side 112 of refrigerator appliance 100 such that a user may operate dispensing assembly 140 without opening refrigerator door 128. In addition, dispenser recess 142 is positioned at a predetermined elevation convenient for a user to access water/ice and enabling the user to access water/ice without the need to bend over.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. In contrast, inside refrigerator appliance 100, refrigerator door 128 may define an icebox 150 (FIGS. 2 and 3) housing an icemaker and an ice storage bin 152 that are configured to supply ice to dispenser recess 142. In this regard, for example, icebox 150 may define an ice making chamber 154 for housing an ice making assembly, a storage mechanism, and a dispensing mechanism.

As further shown in FIG. 1, refrigerator appliance 100 may include a control panel 160 that may represent a general-purpose Input/Output ("GPIO") device or functional block for appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads. Additionally, appliance 100 may include a display 166, such as a digital or analog display device generally configured to provide visual feedback regarding the operation of appliance 100. For example, display 166 may be provided on control panel 160 and may include one or more status lights, screens, or visible indicators. According to exemplary embodiments, user input devices 162 and display 166 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Appliance 100 may further include or be in operative communication with a processing device or a controller 164 that may be generally configured to facilitate appliance operation. In this regard, control panel 160, user input devices 162, and display 166 may be in communication with controller 164 such that controller 164 may receive control inputs from user input devices 162, may display information using display 166, and may otherwise regulate operation of appliance 100. For example, signals generated by controller 164 may operate appliance 100, including any or all system components, subsystems, or interconnected devices, in response to the position of user input devices 162 and other control commands. Control panel 160 and other components of appliance 100 may be in communication with controller 164 via, for example, one or more signal lines or shared communication busses. In this manner, Input/Output ("I/O") signals may be routed between controller 164 and various operational components of appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, timers, etc. In addition, these "controllers" are not necessarily restricted to a single element but may include any suitable number, type, and configuration of processing devices integrated in any suitable manner to facilitate appliance operation. Alternatively, controller 164 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software. The controller 164 may also include one or more timers configured to operate various systems on a timed schedule or send various operating commands after an elapsed time period.

Controller 164 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 164 may be operable to execute programming instructions or micro-control code associated with an operating cycle of appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 164 as disclosed herein is capable of and may be operable to perform any methods, method steps, or portions of methods as disclosed herein. For example, in some embodiments, methods disclosed herein may be embodied in programming instructions stored in the memory and executed by controller 164.

The memory devices may also store data that can be retrieved, manipulated, created, or stored by the one or more processors or portions of controller 164. The data can include, for instance, data to facilitate performance of methods described herein. The data can be stored locally (e.g., on controller 164) in one or more databases and/or may be split up so that the data is stored in multiple locations. In addition, or alternatively, the one or more database(s) can be connected to controller 164 through any suitable network(s), such as through a high bandwidth local area network (LAN) or wide area network (WAN). In this regard, for example, controller 164 may further include a communication module or interface that may be used to communicate with one or more other component(s) of appliance 100, controller 164, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 3:
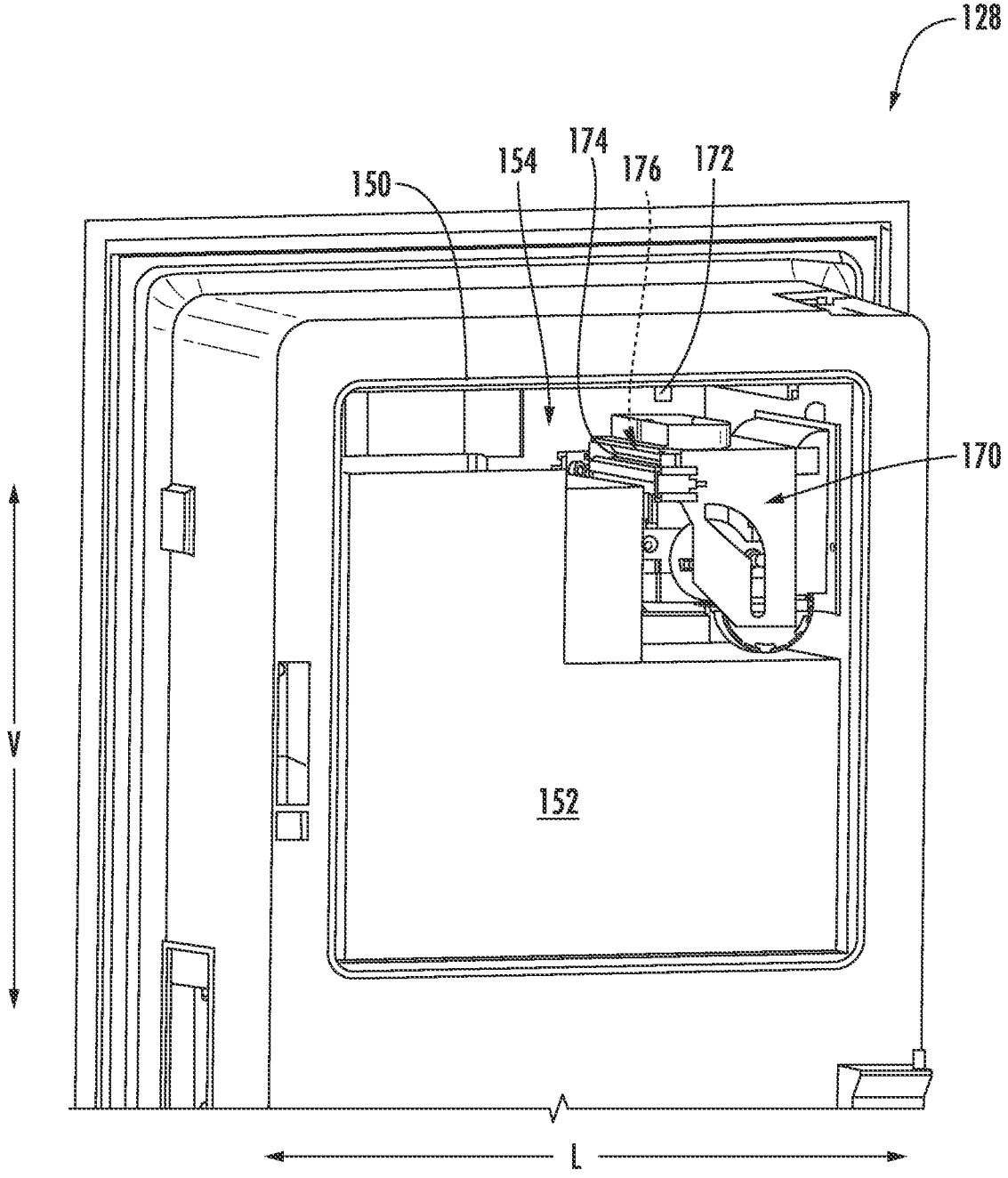
FIG. 3 provides a perspective view of an icebox and ice making assembly of the refrigerator appliance of FIG. 1.

FIG. 3 provides a perspective view of an icebox and ice making assembly 170 of refrigerator appliance 100. As illustrated, ice making assembly 170 is mounted on or to icebox 150 within ice making chamber 154 and is configured for receiving a flow of water from a water supply conduit 172. In this manner, ice making assembly 170 is generally configured for freezing the water to form ice cubes which may be stored in storage bin 152 and dispensed through discharging outlet 146 (FIG. 1) by dispensing assembly 140 (FIG. 1). It should be appreciated that ice making assembly 170 is described herein for explaining inventive aspects of the present subject matter and that variations and modifications may be made to ice making assembly 170 while remaining within the scope and spirit of the present subject matter. For example, in some alternative embodiments, ice making assembly 170 may be positioned within freezer chamber 124 of refrigerator appliance 100 and may have any other suitable configuration.

As depicted in FIG. 3, ice making assembly 170 includes a resilient ice mold 174 that defines a mold cavity 176. In general a resilient ice mold 174 is positioned below water supply conduit 172 for receiving the gravity-assisted flow of water from water supply conduit 172. Resilient ice mold 174 may be constructed from any suitable resilient material that may be deformed to release ice cubes after formation. For example, according to the illustrated embodiment, resilient ice mold 174 is formed from silicone or another suitable hydrophobic, food-grade, and resilient material.

Generally, water supply conduit 172 is configured for refilling resilient ice mold 174 (which may include multiple mold cavities 176) to a predetermined level. In embodiments in which resilient ice mold 174 includes multiple mold cavities 176, water supply conduit 172 may supply a precise amount of water to fill the cavities 176 evenly and without overflowing any of the cavities 176. In accordance with exemplary aspects of the present subject matter, a precise fill dispensing assembly may be provided upstream of ice making assembly 170 to provide fixed or controlled volume of water to ice making assembly 170.

Figure 4:
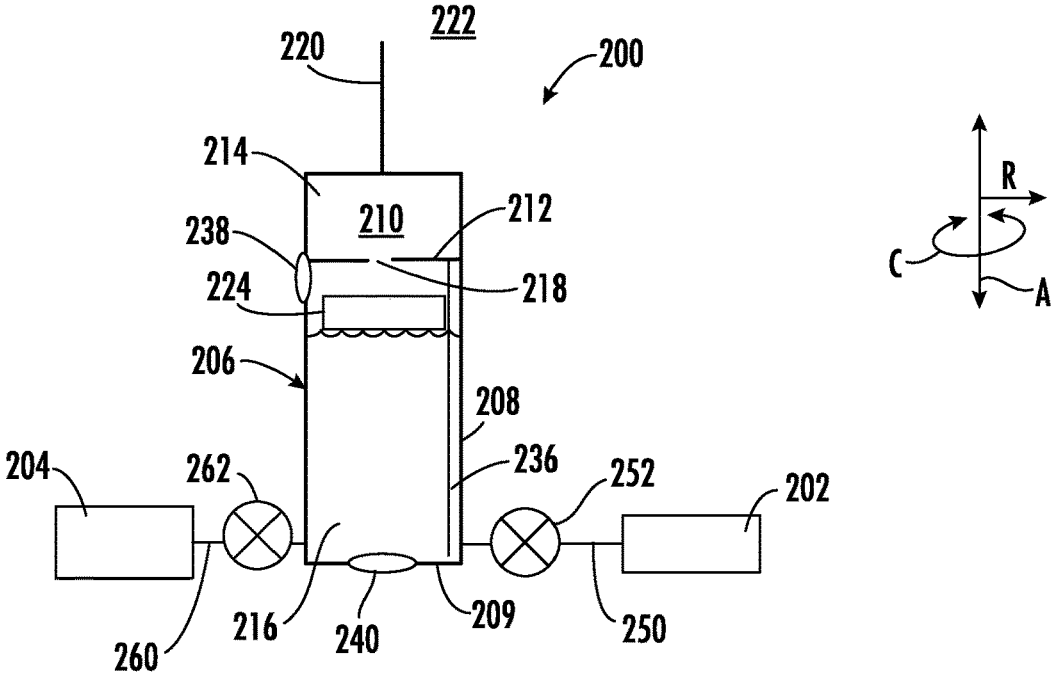
FIG. 4 provides a side sectional view of a fluid metering system in accordance with an embodiment of the present disclosure.

FIG. 4 provides a side sectional view of one exemplary embodiment of a precise fluid metering system 200 according to an exemplary embodiment of the present subject matter. Generally, fluid metering system 200 is operable to dispense a precise or controlled volume of water from a water supply 202 to a downstream assembly 204. For instance, fluid metering system 200 may be employed to deliver a precise or controlled volume of water from a water supply line (i.e., the water supply) to ice making assembly 170 of FIG. 3 (i.e., the downstream assembly 204) of refrigerator appliance 100 (FIG. 1). However, as will be appreciated, the exemplary fluid metering system 200 may be employed to deliver a precise or controlled volume of water to other downstream assemblies of an appliance, such as e.g., dispensing assembly 140 of refrigerator appliance 100 (FIG. 1), a reservoir of a coffee brewing system, etc. Fluid metering system 200 may be located in any suitable location within an appliance, e.g., upstream of ice making assembly 170 within door 128 of refrigerator appliance 100 (FIGS. 1 and 3).

As shown, fluid metering system 200 includes a housing 206 including a perimetral wall 208 defining a chamber 210. For this embodiment, chamber 210 of housing 206 is cylindrical, but other shapes may be used in other embodiments without departing from the present disclosure. As a cylindrical housing 206, in the present embodiment, the housing 206 defines an axial direction A, a radial direction R generally perpendicular to the axial direction A, and a circumferential direction C. The system 200 is oriented such that the axial direction A is generally parallel to the vertical direction V of the refrigerator appliance 100. A flange 212 divides the chamber 210 into an upper chamber 214 and a lower chamber 216. The flange 212 defines a vent hole 218 which places the upper chamber 214 in fluid communication with the lower chamber 216. In some embodiments, a vent tube 220 provides fluid communication between the upper chamber 214 and the external atmosphere 222. The external atmosphere 222 is an atmosphere external to the housing 206 and may also be external to the cabinet 102.

Figure 5:
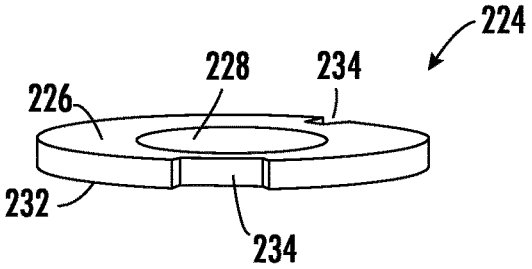
FIG. 5 provides a perspective view of a float in accordance with an embodiment of the present disclosure.

A float 224 is disposed in the lower chamber 216 and constrained for axial displacement between a lowered position spaced apart from the flange 212 and a raised position in which the float 224 engages the flange 212. In particular, in the raised position, float 224 contacts the vertically lower (i.e., bottom) surface of the flange 212 and blocks, or substantially blocks, fluid communication between the upper chamber 214 and the lower chamber 216. As illustrated in FIGS. 4 and 5, float 224 may comprise a flange contacting surface, planar surface 226, configured to seal the vent hole 218 in the flange 212. In the raised position, planar surface 226 engages the flange 212 to at least substantially seal the vent hole 218. In some embodiments, the planar surface 226 includes a sealing portion 228 particularly formed to provide a seal with a portion of the flange proximate to the vent hole. For example, in FIG. 5, sealing portion 228 may have a texture or construction, or be formed of a material, suitable for sealing with the flange 212 at the vent hole 218. The texture of the sealing portion 228 may be a smooth finish to facilitate formation of a seal at the flange 212. The construction of the sealing portion 228 may be a modified construct to facilitate sealing with the flange 212. For example, the sealing portion 228 may be treated to be a resilient portion to deflect when in contact with the flange 212 to enhance the sealing effectiveness.

Figure 6:
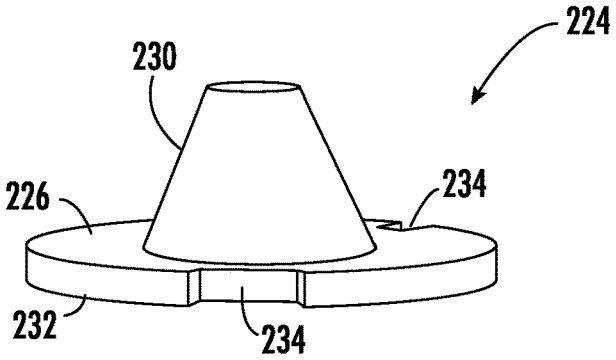
FIG. 6 provides a perspective view of a float in accordance with an embodiment of the present disclosure.

In the exemplary embodiment of FIG. 6, the sealing portion 228 is a raised radial surface 230 configured to be received in vent hole 218 and seal against the perimeter of the vent hole 218, the perimeter defined by the flange 212. The raised radial surface 230 may be a conic section as illustrated or may be a spherical or semi-spherical section disposed on the planar surface 226. Additionally, the raised radial surface 230 may have one or more of the texture, construction, or material choice described above with respect to the sealing portion 228.

In some embodiments, the perimeter 232 of float 224 includes one or more radial notches 234 (two shown in FIGS. 5 and 6). At least one of the radial notches 234 is configured to receive an inwardly directed radial rib 236 in a sliding arrangement. The radial rib 236 generally extends inwardly from the perimetral wall 208 and extends in the axial direction from the flange 212 to the bottom wall 209. When received in the radial notch 234, the rib 236 and the notch 234 cooperate to substantially prevent circumferential displacement of the float 224 with respect to the housing 206. The radial notch 234 is sufficiently large compared to the radial rib 236 to provide a bypass space that may allow fluid communication between the portion of the lower chamber 216 that is below the float 224 and the portion that is above the float 224. In some embodiments, the number of radial notches 234 exceeds the number of radial ribs 236 to provide bypass space.

In the illustrative embodiment of FIG. 4, fluid metering system 200 includes a supply conduit 250 providing fluid communication between the water supply 202 and the lower chamber 216. A supply valve 252 is fluidly coupled to the supply conduit 250 between the water supply 202 and the lower chamber 216. The supply valve 252 is in operative communication with the controller 164 and operable between an open position allowing the flow of water in the supply conduit 250 from the water supply 202 to the lower chamber 216 and a closed position blocking the flow of water in the supply conduit 250.

As further illustrated in FIG. 4, a delivery conduit 260 provides fluid communication between the lower chamber 216 and the downstream assembly 204. According to the present embodiment, the downstream assembly 204 comprises the ice making assembly 170. A delivery valve 262 is fluidly coupled to the delivery conduit between the lower chamber 216 and the downstream assembly 204. The delivery valve 262 is in operative communication with the controller 164 and operable between an open position allowing the flow of water in the delivery conduit 260 from the lower chamber 216 to the downstream assembly 204 and a closed position blocking the flow of water in the delivery conduit 260.

In embodiments, a position sensor 238 may be provided to sense the presence of the float 224 at the flange 212 (i.e., at the raised position) and communicate a position sensor signal to the controller 164. The sensor may be any suitable sensor capable of sensing the presence of float 224 at the flange, for example a hall effect sensor. The sensor may be inoperable communication with the controller 164 to provide a signal to the controller 164 indicating the float 224 is at the flange 212. The controller may use the signal form the position sensor 238 in operating the supply and delivery valves 252, 262.

According to the illustrated embodiment of FIG. 4, fluid metering system 200 includes one or more ultra violet (UV) light sources (one shown) configured and positioned to illuminate the chamber 210 and all wetted surfaces inside the chamber 210. The controller 164 may be in operative communication with the UV light source 240 and instruct the UV light source 240 to provide continuous illumination to the chamber 210 or may intermittently provide illumination. As generally understood, UV light may be used as a germicide to disinfect surfaces and water. In the present disclosure, the UV light may be used to disinfect the water flowing through the fluid metering system 200 and the surfaces of the fluid metering system 200 that may come in contact with the water flowing from the water supply 202 to the downstream assembly 204 (i.e., the wetted surfaces). The wetted surfaces may include the perimetral wall 208, the flange 212, the chamber 210 (including the upper and lower chambers 214, 216), the float 224, and the vent tube 220.

Figure 7:
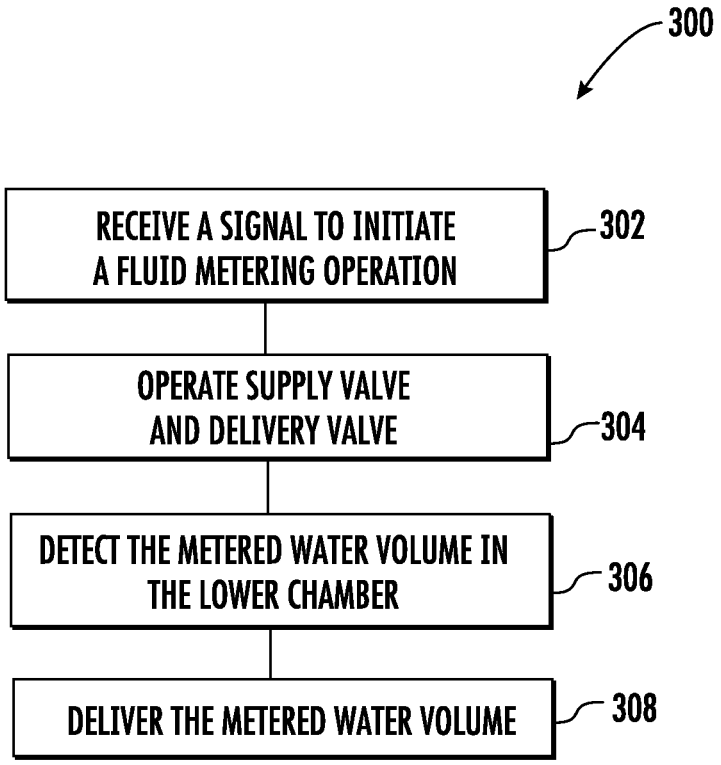
FIG. 7 illustrates a method of operating a fluid metering system in accordance with an embodiment of the present disclosure.

Now that the construction of fluid metering system 100 and the configuration of controller 164 according to exemplary embodiments have been presented, an exemplary method 300 of operating the fluid metering system will be described. Referring to FIG. 7, method 300 includes, at step 302, receiving a signal to initiate a fluid metering operation. For example, the controller 164 may be in operative communication with, and configured to receive signals from, the downstream assembly 204. The signal to initiate may be communicated from the downstream assembly 204 to the controller 164, for example, the signal may be a demand signal corresponding to a need for ice at the ice making assembly 170.

At 304, in response to the signal received at 302, the controller 164 operates the supply and delivery valves 252, 262 to positions facilitating the flow of water to the lower chamber 216. The controller 164 provides a signal to operate the delivery valve 262 to a closed position and the supply valve 252 to an open position, allowing a flow of water from the water supply 202 into the chamber 210, specifically the lower chamber 216. The delivery valve 262 in the closed position prevents water from flowing out of the lower chamber 216 causing the water level in the lower chamber to rise.

The water volume flowing into the lower chamber moves the float 224 to the raised position. At 306, the full metered volume of water is detected in the lower chamber. Controller 164 is configured to sense the vent hole 218 is sealed and the lower chamber 216 is filled with the water volume to be dispensed. In some embodiments, the sensor 238 detects the presence of the float and communicates a signal to the controller 164 indicating that the float 224 is positioned against the flange 212. In other embodiments, a timer in the controller 164 operates the supply valve 152 to an open condition for a predetermined period of time. The predetermined period of time may be calculated or empirically derived to allow a desired volume of water to flow into the lower chamber 216, filling the lower chamber. In other embodiments, a flow detector may be fluidly coupled to the supply conduit 252 and in operative communication with the controller 164. When the lower chamber is filed and the float seals the vent hole 218, the flow of water in the supply conduit will be reduced to a lower limit, for example the flow will cease. At the lower limit of water flow, the flow detector may signal the controller that the metered volume of water is present in the lower chamber 216.

As the lower chamber 216 fills with water from supply conduit 250, the float 224 is moved to the raised position and contacts the vertically lower (i.e., bottom) surface of the flange 212. The sealing portion 228 of the float 224 blocks, or substantially blocks, fluid communication between the upper chamber 214 and the lower chamber 216 at the vent hole 218. Thus the float 224 seals the vent hole 218 in the flange 212 and the metered fluid volume (i.e., the volume to be dispensed) is defined within the lower chamber by the housing 206, the float 224, and the flange 212.

As the float 224 moves to the raised position, air contained in the chamber vertically above the float is compressed. In some embodiments, the upper chamber 214 is sufficiently large that the anticipated water pressure from the supply conduit 250 will compress the air above the float 224 and pressurize the upper chamber 214 when the float 224 is in the raised position. In other embodiments, a vent tube 220 provides fluid communication between the upper chamber and an atmosphere external to the chamber 210 (i.e., the atmosphere outside of the cabinet 102). As the float 224 rises, the air above the float is forced into the upper chamber 214 and exhausts through the vent tube 220 to the atmosphere.

At 308, the controller positions the supply and delivery valves 252, 262 to deliver the metered water volume, for example to the ice making assembly 170, or other downstream assembly 204. To facilitate supply of the metered volume of water, the controller 164 operates the supply valve to a closed position, isolating the fluid metering system 200 from the water supply 202. The controller then operates the delivery valve 262 to the open position, dispensing the metered volume of water contained in the lower chamber 216 to the downstream assembly 204.

In some embodiments, a single metered water flow provides a desired volume of water to the downstream assembly 204. In other embodiments, multiple metered water volumes may be necessary to provide the desired volume of water. In embodiments including an ice making assembly 170, dispensing multiple metered water volumes to the resilient ice mold 174 may be used to achieve desired ice characteristics.

At any point during the fill and dispense cycle described above, the controller may energize the UV light source 240 to illuminate the chamber 210. The UV light source 240 may continuously or intermittently illuminate some or all of the fluid metering system 200 under the instruction of the controller 164.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fluid metering system for an ice making assembly, the fluid metering system defining an axial direction, a radial direction, and a circumferential direction, the fluid metering system comprising:

a housing comprising a perimetral wall defining a chamber;

a flange dividing the chamber into an upper chamber and a lower chamber, the flange defining a vent hole;

a float constrained for axial displacement within the lower chamber between a lowered position in which the float is spaced apart from the flange and a raised position in which the float engages the flange;

a supply conduit providing fluid communication between the lower chamber and a water supply;

a delivery conduit providing fluid communication between the lower chamber and an ice mold;

a supply valve fluidly coupled to the supply conduit between the lower chamber and the water supply;

a delivery valve fluidly coupled to the delivery conduit between the lower chamber and the ice mold; and a controller in operative communication with the supply valve and the delivery valve, the controller configured to:

operate the delivery valve to a closed position and operate the supply valve to an open position to allow a fluid volume to flow from the water supply to the lower chamber, wherein the fluid volume moves the float to the raised position and the fluid volume is defined within the lower chamber by the housing, the float, and the flange; and operate the supply valve to a closed position and operate the delivery valve to an open position to allow the fluid volume to flow from the lower chamber to the ice mold.

2. The fluid metering system of claim 1, wherein the upper chamber includes a vent to an external atmosphere.

3. The fluid metering system of claim 1, further comprising a position sensor configured to sense the float in the raised position.

4. The fluid metering system of claim 3, wherein the position sensor is a hall effect sensor.

5. The fluid metering system of claim 3, wherein:

the controller is in operable communication with the position sensor; and the position sensor communicates a position sensor signal to the controller corresponding to the float in the raised position.

6. The fluid metering system of claim 5, wherein the controller operates the supply valve to the closed position and operates the delivery valve to the open position upon receipt of the position sensor signal corresponding to the float in the raised position.

7. The fluid metering system of claim 1, wherein the float comprises a flange contacting surface configured to seal the vent hole in the raised position.

8. The fluid metering system of claim 7, wherein the flange contacting surface is a planar surface configured to seal against the flange.

9. The fluid metering system of claim 7, wherein the flange contacting surface includes a raised radial surface configured to be received in the vent hole and seal against a perimeter of the vent hole.

10. The fluid metering system of claim 1, wherein the float includes a perimeter comprising one or more radial notches, at least one of the one or more radial notches receives an inwardly directed radial rib extending from the perimetral wall, substantially preventing radial displacement of the float with respect to the housing.

11. The fluid metering system of claim 1, further comprising an ultra violet light source configured to illuminate the chamber.

12. A refrigerator appliance comprising:

a fluid metering system for dispensing fluid to an ice making assembly, the fluid metering system comprising:

a housing comprising a perimetral wall defining a chamber;

a flange dividing the chamber into an upper chamber and a lower chamber, the flange defining a vent hole;

a float constrained for axial displacement within the lower chamber between a lowered position in which the float is spaced apart from the flange and a raised position in which the float engages the flange;

a supply conduit providing fluid communication between the lower chamber and a water supply;

a delivery conduit providing fluid communication between the lower chamber and an ice mold;

a supply valve fluidly coupled to the supply conduit between the lower chamber and the water supply;

a delivery valve fluidly coupled to the delivery conduit between the lower chamber and the ice mold; and a controller in operative communication with the supply valve and the delivery valve, the controller configured to:

operate the delivery valve to a closed position and operate the supply valve to an open position to allow a fluid volume to flow from the water supply to the lower chamber; and operate the supply valve to a closed position and operate the delivery valve to an open position to allow the fluid volume to flow from the lower chamber to the ice mold;

wherein the lower chamber, the float in the raised position, and the flange define the fluid volume.

13. The refrigerator appliance of claim 12, wherein the fluid metering system further comprises a vent to an external atmosphere.

14. The refrigerator appliance of claim 12, wherein the fluid metering system further comprises a position sensor configured to sense the float in the raised position and communicate a position sensor signal to the controller corresponding to the float in the raised position.

15. The refrigerator appliance of claim 14, wherein the controller operates the supply valve to the closed position and operates the delivery valve to the open position upon receipt of the position sensor signal corresponding to the float in the raised position.

16. The refrigerator appliance of claim 12, wherein the float further comprises a flange contacting surface configured to seal the vent hole in the raised position.

17. The refrigerator appliance of claim 16, wherein the flange contacting surface is one of a planar surface configured to seal against the flange or a raised radial surface configured to be received in the vent hole and seal against a perimeter of the vent hole.

18. The refrigerator appliance of claim 16, wherein the float includes a perimeter comprising one or more radial notches, at least one of the one or more radial notches receives an inwardly directed radial rib extending from the perimetral wall, substantially preventing radial displacement of the float with respect to the housing.

19. The refrigerator appliance of claim 12, wherein the fluid metering system further comprising an ultra violet light source configured to illuminate the chamber.

20. A method of operating a fluid metering system comprising a chamber divided into an upper chamber and a lower chamber by a flange, a float constrained for axial displacement within the lower chamber, a delivery conduit, a supply conduit, a supply valve, and a delivery valve, the method comprising:

receiving a signal to initiate a fluid metering operation;

operating a supply valve to an open position and a delivery valve to a closed position;

detecting a metered water volume in the lower chamber in response to a float within the lower chamber being in a raised position whereby the float engages a flange dividing the lower chamber from an upper chamber; and delivering the metered water volume in response to detection of the metered water volume.

* * * * *